US005231414A

United States Patent [19]

Ladds

[11] Patent Number: 5,231,414

[45] Date of Patent: Jul. 27, 1993

[54] CENTER-FED LEAKY WAVE ANTENNA

[75] Inventor: John P. Ladds, Cambridge, Mass.

[73] Assignee: GTE Laboratories Incorporated, Waltham, Mass.

[21] Appl. No.: 813,223

[22] Filed: Dec. 23, 1991

[51] Int. Cl.[5] ..... H01Q 1/36

[52] U.S. Cl. ..... 343/895; 343/785

[58] Field of Search ..... 343/771, 785, 786, 700, 343/700 MS, 895; 333/21

[56] References Cited

U.S. PATENT DOCUMENTS

| | | | |
|---|---|---|---|
| 3,555,554 | 1/1971 | Chung-Shu Kuo | 343/895 |
| 3,969,732 | 7/1976 | Holloway | 343/895 |
| 4,085,406 | 4/1978 | Schmidt et al. | 343/895 |
| 4,387,379 | 6/1983 | Hardie | 343/895 |
| 4,536,767 | 8/1985 | Rembold et al. | 343/785 |
| 5,049,895 | 9/1991 | Ito et al. | 343/785 |

*Primary Examiner*—Rolf Hille
*Assistant Examiner*—Tan Ho
*Attorney, Agent, or Firm*—J. Stephen Yeo

[57] ABSTRACT

An antenna has a dielectric slab with an inner surface and an outer surface. The inner surface is mounted on a metal backplate. A radiating spiral is located on the outer surface of the dielectric slab and has a pitch of one wavelength at the design frequency. A circular waveguide, for providing RF energy in the $TM_{01}$ mode, passes through the metal backplate to terminate at the inner surface of the dielectric slab. A metal cap is located on outer surface of the dielectric slab coaxial with the circular waveguide and at the center of the spiral. The metal cap has a surface is sloped away from the outer dielectric surface and has one or more concentric choke grooves formed on the sloped surface. The grooves are one quarter wavelength deep at the design frequency.

2 Claims, 1 Drawing Sheet

CENTER-FED LEAKY WAVE ANTENNA

FIELD OF THE INVENTION

This invention relates to antennas, and more particularly is concerned with leaky wave antennas.

BACKGROUND OF THE INVENTION

Side-fed leaky-wave planer antennas have a feed waveguide which couples RF energy via slots to a slab-line consisting of a dielectric slab backed by a metal ground plane. The preferred mode is designated $TM_{01}$. The $TM_{01}$ mode has a component of electric field at the surface of the dielectric in the direction of propagation. Radiating elements are spread one wavelength apart across the slab. As a consequence of this spacing and the spacing of feed slots of the feed waveguide, at one frequency all the radiating elements are in phase and the resulting beam is broadside to the array. With a side fed antenna, when the operating frequency is changed, the beam will scan as the phase relationship changes between radiating elements. For communications applications it is desirable to have a beam that is fixed in direction if the operating frequency is scanned over a band.

In U.S. Pat. No. 5,005,022, Blaisdell disclosed that a solution to the beam scanning problem is to feed RF energy from the center of a circular leaky-wave antenna. The electrical length from the center to each point equidistant from the center will remain the same with change of operating frequency. The antenna may be regarded as being made up of pairs of radiating elements equidistant and opposite one another. Radiation from diametrically opposed radiating elements will be in phase since they are one guide wavelength apart. The radiating field is an on-axis broadside beam and remains on axis as the frequency changes since the electrical length to paired radiating elements will remain equal.

Blaisdell calls for a transition from circular waveguide to surface wave on a dielectric slab. It is desired to provide a center-fed leaky wave antenna having an improved transition from circular waveguide to surface wave on a dielectric slab.

SUMMARY OF THE INVENTION

According to one aspect of the invention, there is provided an antenna which includes a dielectric slab with an inner surface and an outer surface. The inner surface is mounted on a metal backplate. A radiating spiral is located on the outer surface of the dielectric slab and has a pitch of one wavelength at the design frequency. A circular waveguide, for providing RF energy in the $TM_{01}$ mode, passes through the metal backplate to terminate at the inner surface of the dielectric slab. A metal cap is located on outer surface of the dielectric slab coaxial with the circular waveguide and at the center of the spiral. The metal cap has a surface which is sloped away from the outer dielectric surface and has one or more concentric choke grooves formed on the sloped surface. The grooves are one quarter wavelength deep at the design frequency.

DETAILED DESCRIPTION OF THE INVENTION

Figure 1:
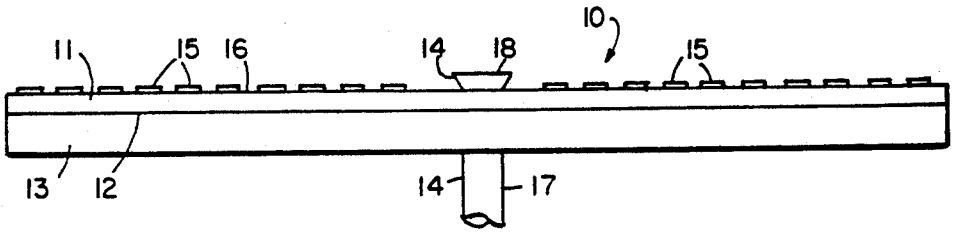
FIG. 1 illustrates an antenna embodying the invention.

Referring first to FIG. 1, there is seen an antenna 10 embodying the invention. Antenna 10 includes a dielectric slab 11, preferably disk shaped. The inner side 12 of dielectric slab 11 is mounted on a metal backplate 13 which functions as as ground plane. A surface wave launcher 14, also called a transition, serves to transfer RF energy in the $TM_{01}$ mode from a circular waveguide feed into a $TM_{01}$ mode wave travelling radially in dielectric slab 11.

The $TM_{01}$ mode in a dielectric slab is considered infinite in the direction transverse to the direction of propagation. The mode is essentially the same for propagation in a radial direction. This mode has no cut-off frequency and therefore the dielectric thickness is not critical, however, a dielectric thickness that does not allow other modes to propagate is preferred.

The $TM_{01}$ mode in a disk shaped dielectric slab has a transverse magnetic field running circumferentially round the disk. RF energy, fed from a circular waveguide in the $TM_{01}$ mode, has magnetic field with circular symmetry running circumferentially round the waveguide. A component of the electric field is at the outer surface of the dielectric in the direction of propagation, and called a surface wave. The electric and magnetic fields of a surface wave are mostly in the dielectric and decay exponentially away from the outer dielectric surface.

As a first feature of the invention, radiation from the surface wave is by a radiating spiral 15 located on the outer surface 16 of dielectric slab 11 and having a pitch of one wavelength at the design frequency for every 360 degrees of rotation. The spiral construction results in circular polarization since the spiral 15 has a pitch of one wavelength for one rotation round the antenna disk. The phase relationship to give radiation on-axis and circular polarization will only be true at a single frequency. The far field beam will remain on-axis with change of frequency, although the on-axis gain and the axial ratio of the polarization will deteriorate with deviation from the center frequency. Radiating spiral 15 may be a continuous slab-line conductive strip, arc-shaped or discrete radiating elements such as circular patches disposed on a spiral.

Figure 2:
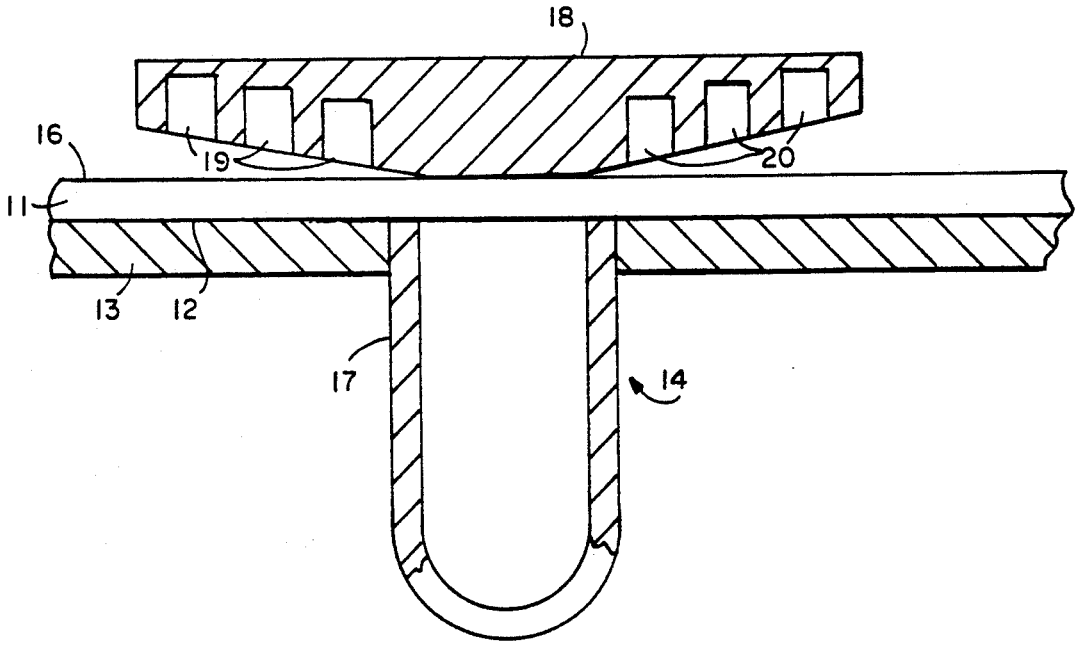
FIG. 2 is a cross sectional view of a surface wave launcher used in the antenna.

As a second feature of the invention, surface wave launcher 14 includes a circular waveguide 17 for propagating RF energy in a circularly symmetric mode, and a metal cap 18. As seen in the cross sectional view of FIG. 2, circular waveguide 17 passes through metal backplate 13 to terminate at the inner dielectric surface 12 of dielectric slab 11 opposite the center of spiral 15. Metal cap 18 is located on the outer dielectric surface 16 of dielectric slab 11, coaxial with circular waveguide 17 and at the center of spiral 15. In the circular coupling region about surface wave launcher 14, there are electric and magnetic fields beyond the outer dielectric surface 16 adjacent to cap 18. To attenuate these fields as they reach the coupling region, the side surface 19 of metal cap 18 is sloped away from the outer dielectric surface 16. Cap 18 is shaped as a truncated cone. One or more concentric choke grooves 20 are formed on sloped surface 19. The choke grooves 20 are one quarter wavelength deep at the design frequency, and the short circuit at the bottom of each groove 20 is transformed to an open circuit at the sloping metal surface 19. The open circuit prevents current flow along surface 19 and minimizes the associated fields. A plurality of grooves reinforces this effect so that the fields are forced away from slopping metal surface 19 and toward outer dielectric surface 16 and radiating element 15. The grooves may be one quarter wavelength wide and spaced one eight wavelength apart.

In one example, an 11 inch diameter 47 GHz. antenna is fabricated. The antenna uses a Teflon-fiberglass circuit board material with a dielectric constant of 2.17. The material is 0.060 inches thick and is bonded to an aluminum back plate of 12 inches diameter. The radiating element is copper spiral etched on the outer surface with 23 turns from inside to outside. The pitch of the spiral is one wavelength at a design frequency of 47 GHz. Preferably, the spiral starts out with a width of 0.005 inches, tapering up to a 0.025 width over the first three full inner turns of the spiral. The purpose of the tapered width is to radiate less RF energy at each turn and spread the energy out towards the edge of the disk. At the edge, the dielectric may be tapered in a thickness to provide a good match to any energy left at the periphery and to make provision for bonding of loss material. A load at the edge of the antenna absorbs energy not radiated. Without the load, there may be excessive radiation from the edge. Moreover, the reflected power will cause the axial ratio to deteriorate.

There has been shown and described what are at present considered the preferred embodiment of the invention, and best mode of practicing the invention. In view of these teachings, it will now be obvious to those skilled in the art that various changes and modifications can be made therein. Accordingly, the scope of the invention is defined by the following claims.

What is claimed is:

1. An antenna for use at a design frequency comprising:

a metal backplate;

a dielectric slab having an inner dielectric surface and an outer dielectric surface, said inner dielectric surface mounted on said metal backplate;

a radiating spiral, located on the outer dielectric surface and having a pitch of one wavelength at the design frequency;

a circular waveguide for providing RF energy in the $TM_{01}$ mode, said circular waveguide passing through said metal backplate to terminate at said inner dielectric surface; and a metal cap, shaped as a truncated cone, located on said outer dielectric and surface coaxial with said circular waveguide and at the center of said spiral, said metal cap having a sloped surface sloped away from the outer dielectric surface and having one or more concentric choke grooves formed on the sloped surface, each of said grooves one quarter wavelength deep at the design frequency.

2. A surface wave launcher for a dielectric slab having an inner dielectric surface and an dielectric outer surface, said inner dielectric surface mounted on a metal backplate, said surface wave launcher for use at a design frequency and comprising:

a circular waveguide for providing RF energy in the $TM_{01}$ mode, said circular waveguide passing through said metal backplate to terminate at said inner dielectric surface; and a metal cap, shaped as a truncated cone, located on said outer dielectric surface and coaxial with the circular waveguide, said metal cap having a sloped surface sloped away from the outer dielectric surface and having one or more concentric choke grooves formed on the sloped surface, each of said grooves one quarter wavelength deep at the design frequency.

* * * * *